United States Patent [19]

Albright et al.

[11] Patent Number: 4,744,490

[45] Date of Patent: May 17, 1988

[54] TABLE OR LIKE VENDING MACHINE WITH CUSTOMER OPERATED ANTI-THEFT PRODUCT DELIVERY DRAWER

[75] Inventors: Henry J. Albright, West Des Moines; David R. Frerking, Des Moines, both of Iowa

[73] Assignee: Fawn Engineering Corp., Des Moines, Iowa

[21] Appl. No.: 900,181

[22] Filed: Aug. 25, 1986

[51] Int. Cl.[4] ..... G07F 11/36; G07F 11/28; G07F 11/18

[52] U.S. Cl. ..... 221/75; 221/133; 221/241; 221/281; 312/35; 312/284; 211/59.3

[58] Field of Search ..... 221/75, 76, 123, 124, 221/'129, 130, 133, 12, 191, 194, 195, 197, 241, 242, 281, 256; 312/35, 126, 211, 284; 211/59.3; 222/410, 413; 194/202

[56] References Cited

U.S. PATENT DOCUMENTS

| | | | |
|---|---|---|---|
| 2,072,462 | 3/1937 | Mills | 194/202 X |
| 2,300,956 | 11/1942 | Mergens | 221/75 |
| 2,832,506 | 4/1958 | Hatcher | 221/155 X |
| 3,178,055 | 4/1965 | Schuller | 221/75 |
| 3,269,595 | 8/1966 | Krakauer et al. | 221/75 |
| 3,344,953 | 10/1967 | Krakauer et al. | 221/75 |
| 3,441,174 | 4/1969 | Kenney | 221/75 |
| 3,990,754 | 11/1976 | Pitel et al. | 312/35 |
| 3,993,215 | 11/1976 | Cox et al. | 221/75 |
| 4,023,704 | 5/1977 | Pitel et al. | 221/281 X |
| 4,061,245 | 12/1977 | Lotspeich | 221/75 |
| 4,236,649 | 12/1980 | Fellner | 221/281 X |
| 4,240,563 | 12/1980 | Lennartson | 221/75 |
| 4,506,802 | 3/1985 | Lotspeich | 221/75 |
| 4,600,119 | 7/1986 | Olson | 221/75 |

FOREIGN PATENT DOCUMENTS

| | | | |
|---|---|---|---|
| 710650 | 6/1965 | Canada | 194/12 |

*Primary Examiner*—F. J. Bartuska
*Assistant Examiner*—Edward S. Ammeen
*Attorney, Agent, or Firm*—Henderson & Sturm

[57] ABSTRACT

A vending machine (20) comprises a housing (21) and a pair of product vending shelf units (24, 26) mounted within the housing (21) in vertically stacked relation. Each shelf unit has a front end higher than the rear end thereof. A product selection mechanism (29) is mounted within the housing (21) for actuation of each of the shelf units (24,26) to vend a product (90) forwardly therefrom in response to a customer selection. An anti-theft product delivery drawer assembly (31) is mounted below the lower shelf (26) within the housing (21) and receives the vended product in an inner stored position, and exposes the product for retrieval by the customer upon the customer pulling the drawer outwardly, a drawer cover plate (153) slidable outwardly over the drawer (151) as the drawer is pulled outwardly for preventing access to the interior of the vending machine.

2 Claims, 6 Drawing Sheets

TABLE OR LIKE VENDING MACHINE WITH CUSTOMER OPERATED ANTI-THEFT PRODUCT DELIVERY DRAWER

TECHNICAL FIELD

The present invention relates generally to an article vending machine, and more particularly to a vending machine which is placed on a table top or the like for normal usage.

BACKGROUND ART

The present invention relates to an article vending machine for normal use on a table top or the like. This type of vending equipment is used in small offices and canteen-type environments and is not meant to compete with the large, floor model vending machines. However, it is just as desirable to have not only as large and varied a selection of product as possible in the table top unit, but also to provide for a product first-in, first-out arrangement whereby the product which is first placed in the unit will be vended out first, thereby insuring freshness and quality of product. Other requirements of the marketplace relate to a minimal size of the unit, a minimal weight, and a maximum anti-theft provision therefor.

Previous attempts to satisfy all of the aforementioned minimum and maximum requirement have resulted in table top units which are unsatisfactory for a number of reasons. When such unit is provided with first-in, first-out helical feeder coils on a pair of shelves, but with the shelves placed in a horizontal position, the unit housing is of a square-box like design with not only a waste of inner space, but wherein the outside dimensions are satisfactorily large. Additionally, the shelf arrangements have fixed trough and coil dimensions with a fixed type, size and number of products to be delivered.

Another such table top vending unit known in the prior art comprises a large rotary-type product storage wheel, with product available upon coin-permitted opening of the front of the cabinet in front of the product storage compartment after the wheel has been rotated to place the product at the front of the unit. This type machine is likewise very large, bulky and heavy, with an overly complicated and expensive product delivery arrangement. Furthermore, product which is first in is not necessarily vended first out, such that certain of the product may remain in the machine for an unduly long period of time, resulting in loss of quality of the product.

The present invention is directed at overcoming these and other unsatisfactory attempts at fulfilling the requirements of the marketplace and of the manufacturing economies for an inexpensive, compact and lightweight table top vending machine having a maximum of fresh product vending capabilities with a minimum of theft problems.

DISCLOSURE OF THE INVENTION

The invention relates to a small compact vending machine primarily of a molded plastic construction and having a pair of vending shelves which are vertically spaced and each placed with the rear end thereof lower than the front end, within the cabinet. Each shelf is movably mounted within the cabinet between a vending position and a service and/or loading position, and includes a first helix unit mounted on the shelf for dispensing one size of product therefrom, a second helix helix unit mounted parallel to the first helix for dispensing a second product having a different size than the first product, and a divider which is adjustably mounted on the shelf between the first and second helices. Such adjustable mounting of the dividers provides for product vending troughs of different sizes, thereby enabling the dispensing of different sizes of products by different sizes of helices within different sized troughs, all on the same shelf. Furthermore, the drive motor unit for each helix unit, which includes a helical feeder coil, is readily and easily removably mounted to the rear of a shelf without the need of fastening devices, for attachment to the respective coil; wherein the drive motor units and the helical feeder coils can be easily removed as a unit by the operator of the machine while the shelf is in place, all without removing or attaching fastening devices.

The inner sidewalls of the machine cabinet are provided with protrusions and guideways molded therein for supporting the shelves in both inner vending and outer loading positions, utilizing a vertically movable hood for closing and opening the interior of the machine, all main electric and coin mechanisms mounted on one side of the cabinet and separated from the shelves. An anti-theft delivery drawer is mounted below the lower shelf, and is movable against a spring bias between an inner position for receipt of product vended from either shelf and a customer extended position for delivery of product to the customer, with a separate drawer cover movable therewith and thereby for preventing access to the interior of the cabinet from the drawer space at all positions of the drawer.

The upper shelf can be serviced and loaded in its normal position slightly above the lower shelf, but with the hood raised can be raised to an upper position and latched therein in order to provide access to the lower shelf for loading and servicing purposes. The lower shelf has a normal inner vending position within the cabinet, but also can be moved outwardly to an outer extended position, again with the hood raised for easier loading and servicing purposes. The vending shelves are slanted upwardly from the rear of the cabinet, which slanted condition of the shelves utilizes the interior space of the cabinet to the utmost while also providing against inadvertent and accidental vending of product over the end of either shelf, due to the product tending to fail rearwardly from the helical feeder coil within each trough.

Either shelf may be provided with readily removable dividers whereby product delivery troughs of different sizes are readily provided by easy manipulation of the dividers by the operator while the shelves are in place within the cabinet; and further wherein helical feeder coils of different sizes can be variably placed on the same shelf in changeable, predetermined locations within a trough for vending products of different types and sizes, i.e., bags and candy items.

It is an object of this invention to provide a new and novel vending machine for table top or the like mounting.

It is another object of this invention to provide a small lightweight table top-type vending machine which includes at least a pair of vending shelves, each shelf having the capability of vending different types and sizes of product and wrapping from different sized feeding troughs; the quantity of product greater than from known machines of like type.

Still another object of this invention is to provide such a table top vending machine with shelves each having parallel vertically disposed slots formed at the rear thereof, whereby helical feeder coil drive motor units—connected to a coil or not, are readily slid into and out of operative positions with a shelf, using a said slot, without the need of any type of fastening devices; and wherein further a connected drive motor unit and feeder coil may be moved from one slot to another within the same trough, and by the operator while the shelf is mounted within the cabinet in normal vending or loading positions.

Yet another object of this invention is to provide a table top vending machine with an anti-theft delivery drawer movable by the customer from a product receiving position within the cabinet to a product delivery position extended partially outwardly from the cabinet and with a drawer cover mounted over and separately from the drawer for separating the drawer interior from the cabinet interior at all positions of the drawer.

It is another object of this invention to provide a table top vending machine with a customer-operated anti-theft product delivery drawer which operates in turn a separate cover for the drawer, which cover functions to prevent unauthorized entry into the product area of the machine, and also to prevent product which has dropped onto the cover, due to inadvertent withdrawal of the drawer by the customer, from subsequently dropping into the machine behind the drawer.

Yet another object of this invention is to provide a table top vending machine having a customer-operated anti-theft product delivery drawer which automatically operates a separate cover therefor from first, an inner posiiton wherein the drawer is positioned to receive product and the cover is stored, to second an extended position wherein the drawer is positioned to receive the hand of a customer to retrieve product therein and the cover is both extended and raised to provide a larger opening with the drawer than the height of the drawer itself, thereby obviating the pinching of large product, i.e., potato chips, between the cover and the inner front of the machine.

Still another object of this invention is to provide a small, lightweight table top machine for vending a high quantity of product, which machine has a hood raisable about a rear pivot to gain loading and servicing access to the interior; an upper product carrying shelf disposed with the front end thereof raised, readily accessible and removable; a lower product carrying shelf disposed parallel the upper shelf and movable between an inner vending position to an outer loading position and removable; the shelves serviceable as to product, size of feeder coils and troughs and placement of coil drive units while in place and by the operator; with an anti-theft delivery drawer unit movable mounted below the lower shelf; and with the coin mechanism, collection box and electrical components mounted to one side of the shelf arrangement.

Another object of this invention is to provide a table top unit with a hood pivotably movable vertically from a first position enclosing the interior of the machine to a second position exposing said interior for loading and servicing purposes, and movable laterally from a raised position to a third position removed from the remainder of said machine for use of manufacture and assembly.

A companion application filed concurently by common inventors herein having a common Assignee is Ser. No. 06/899,651 filed Aug. 25, 1986.

BRIEF DESCRIPTION OF THE DRAWINGS

These and other objectives of the invention will become readily apparent upon a thorough study and review of the following detailed description of the preferred embodiment for carrying out the invention, particularly when viewed in conjunction with the accompanying drawings, wherein:

FIG. 4 is a horizontal cross sectional view of the vending machine of this invention as taken along the line 4—4 in FIG. 2;

BEST MODE FOR CARRYING OUT THE INVENTION

Figure 1:
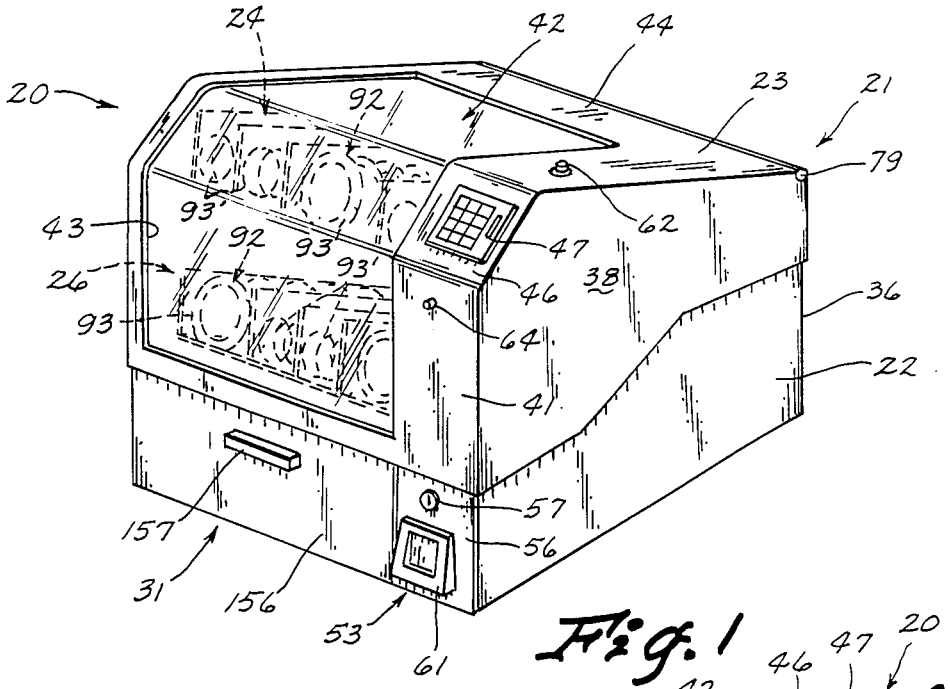
FIG. 1 is a perspective view of the vending machine embodying the present invention.
Figure 5:
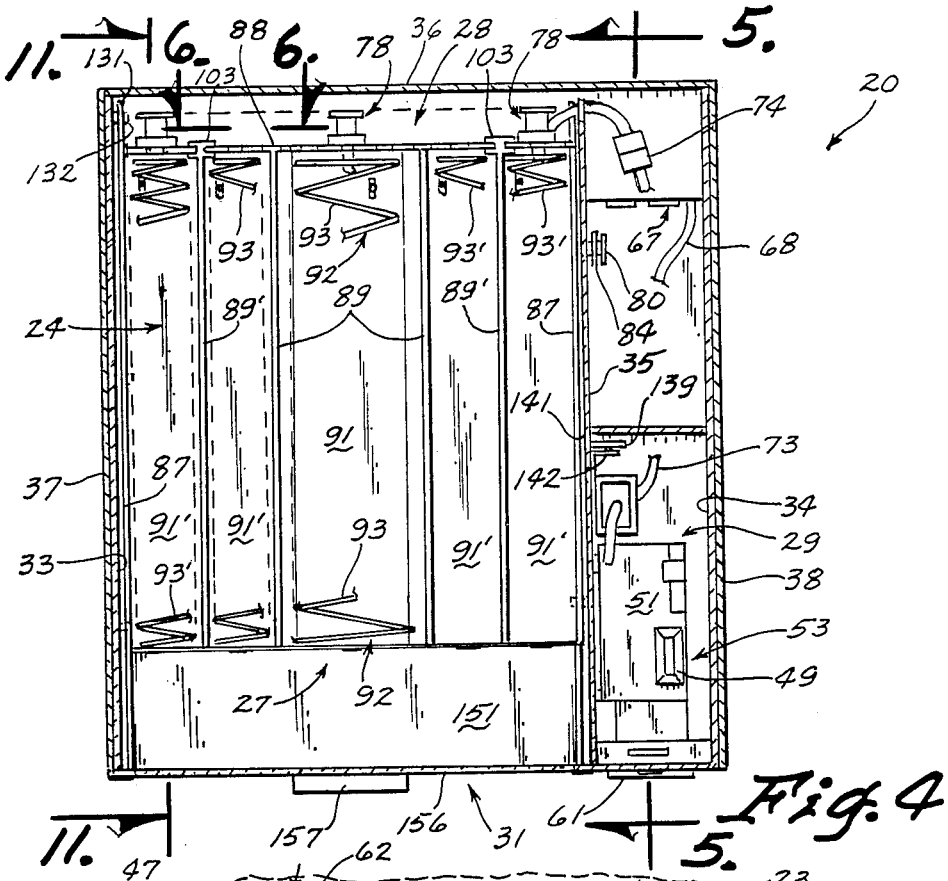
FIG. 5 is a vertical sectional view taken along the line 5—5 in FIG. 4.

Referring now to the drawings, the vending machine of this invention is shown indicated generally at (20) in FIG. 1 and comprises a housing (21) having a rectangular base (22) and a hood (23) pivotally mounted at its rear to the base (22) for arcuate movement to a raised position (FIG. 11); a pair of product vending shelf units vertically stacked within the housing (21) (FIG. 11) and including an upper shelf unit (24) and a lower shelf unit (26) with the front end (27) of each shelf unit (24, 26) disposed higher within the housing (21) than a rear end (28) thereof; product selection apparatus indicated generally at (29) in FIGS. 4 and 5, in this instance coin operated as inserted by the customer, which apparatus is located primarily to one side of the shelf units (24,26) (FIG. 4) and is operable to actuate one of the shelf units (24, 26) to vend a product (90) (FIG. 11) forwardly off the shelf unit; and an anti-theft product delivery drawer assembly (31) (FIGS. 11–14) mounted within the housing (21) below the lower shelf unit (24), the drawer assembly (31) customer operated for movement from an inner product receiving position (FIG. 13) to an outer product deliverying position.

Figure 2:
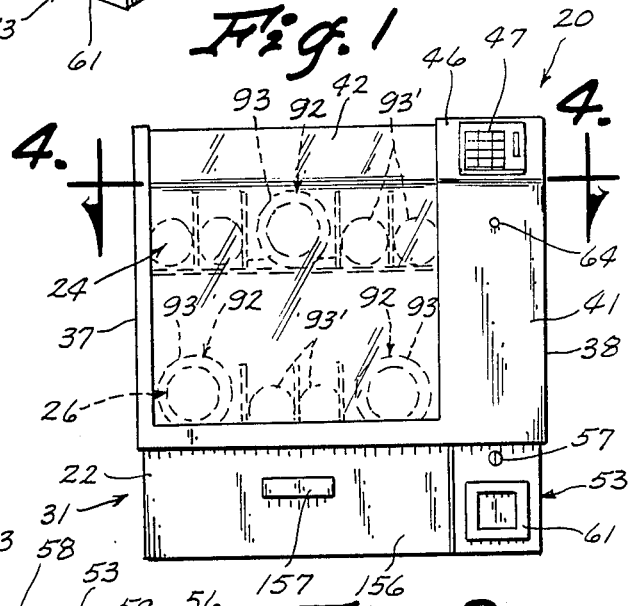
FIG. 2 is a front elevational view thereof.

More specifically, the housing base (22) includes a bottom (32) (FIG. 5), upstanding sidewalls (33, 34) and a rear wall (36). The sidewalls (33, 34) have a height at their rear equal to the height of the rear wall (36), and taper downwardly toward the front of the machine as indicated by the dotted line (39) (FIG. 5), terminating at the top of the delivery drawer assembly (31) on one side and the coin collection box (53) on the other side. An inner vertically disposed wall (35) (FIGS. 4 and 5) is mounted intermediate the shelf area and the major electrical and coin mechanism areas, and has a shape similar to the side silhouette of the machine (20) (see FIGS. 1 and 11). The hood (23) includes side panels (37, 38) adapted to fit over the upper edges (39) (FIG. 14) of the base walls (33, 34), a top and front opaque portion (41) best illustrated in FIGS. 1 and 2, and a top and front transparent portion (42) fitted into a generally rectangular opening (43) formed in the portion (41). It will be noted that the overall height of the front (FIG. 5) of the machine (20) is greater than the overall height of the rear (FIG. 5) of the machine (20), such that main top portion (44) slopes downwardly from front to rear. On the right front side of the minor top portion (46), a combined coin receiving slot and product selection panel membrane unit (47) is mounted, with the coin (48) (FIG. 5) passing downwardly through a chute (49) and a conventional coin mechanism (51) for appropriate discharge either at (48*a*) into the rear collection area (52) of a coin collection box (53) or at (48*b*) into a forward coin return area (54) of the box (53).

Figure 3:
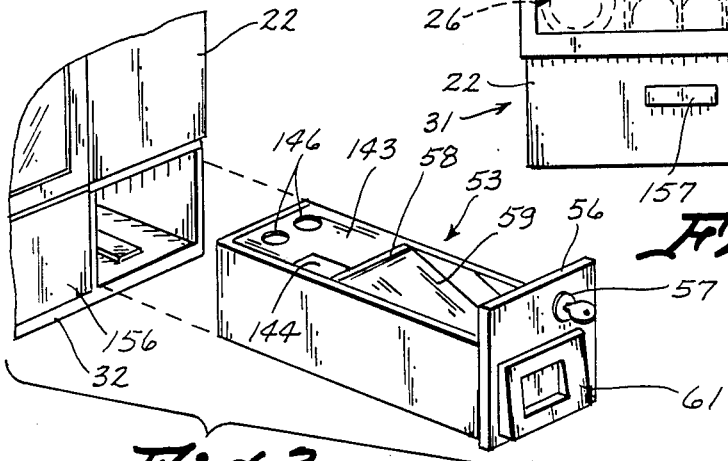
FIG. 3 is an enlarged perspective view of a portion of the machine of FIG. 1, with a coin collection box exploded therefrom.

The coin collection box (53) is shown also in FIG. 3 and comprises a rectangular box with a front face plate (56) having a key-locking unit (57) affixed thereto which is operationally attached to linkage (not shown) for simultaneously locking the hood (23) to the base (22) and the coin box (53) into the base (22), and vise versa as to unlocking. A wall (58) separates the coin areas (52, 54) and a ramp (59) is provided for returning the coins (48*b*) such that a customer may retrieve the coins (48*b*) by inserting fingers past a flap (61) and into the forward area (54).

The hood (23) includes further a customer-depressed plunger unit (62) mounted thereon and operationally connected to a switch unit (63) of the coin mechanism (51) for effecting a coin release where warranted. Further, a light unit (64) is mounted in the face position (66) of the hood (23) for indicating that the customer should use exact change.

The electrical components include generally a transformer unit (67) mounted on the rear wall (36) (FIG. 5) for utilizing 110 volt power from exterior the machine (20) with a power line (68) leading and connected to a circuit board (69) mounted against the underside of the top portion (41), and from which a line (71) supplies power to the light unit (64), another line (72) is connected to the membrane unit (47), and another line (73) is connected to the coin mechanism (51). A pair of electrical plugs (74, 76) lead off the line (73) for conventional connection to each of the shelf units (24, 26) drive motor sets (see FIG. 4) for effecting selective operation of a certain drive motor unit (78) described more in detail hereinafter.

Figure 11:
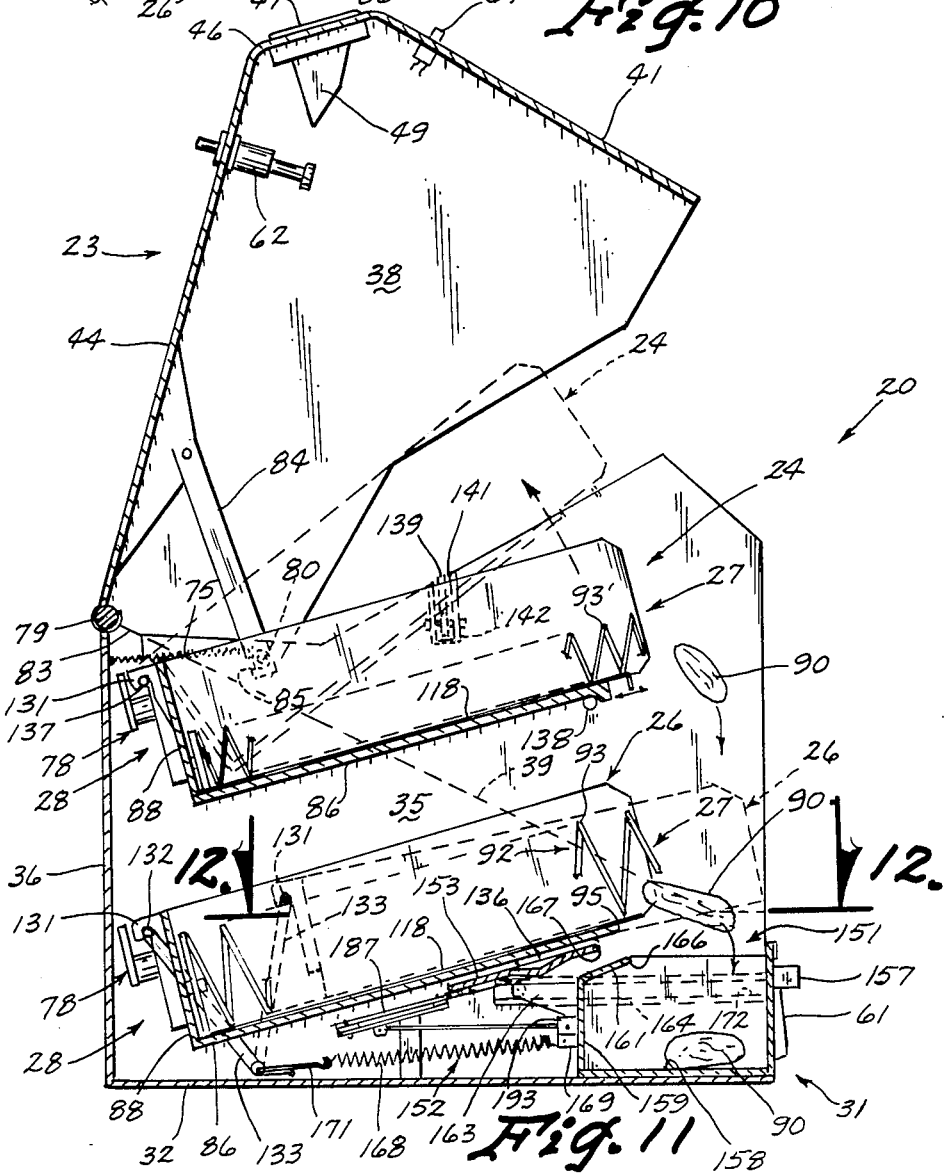
FIG. 11 is a vertical sectional view taken along the line 11—11 in FIG. 4, with certain parts shown in varied positions by the use of dotted lines.
Figure 18:
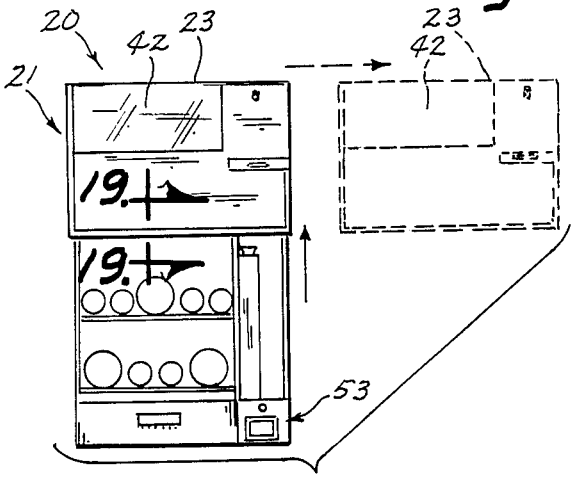
FIG. 18 is a reduced front elevational view of the vending machine of FIG. 1, showing the hood in a raised position in full lines, and showing the hood removed laterally by the use of dotted lines.
Figure 19:
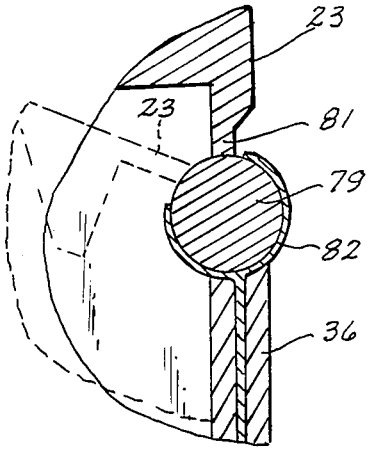
FIG. 19 is an enlarged vertical sectional view taken along the line 19—19 in FIG. 18 and showing the connection of the hood with the vending machine housing.
Figure 15:
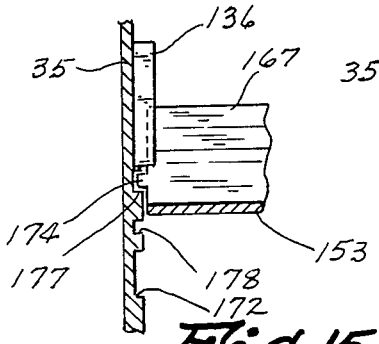
FIGS. 15, 16 and 17 are vertical sectional views taken along the lines 15—15, 16—16, and 17—17 in FIG. 14, and showing the molded groove arrangement of the housing for movement of the anti-theft drawer and cover.
Figure 16:
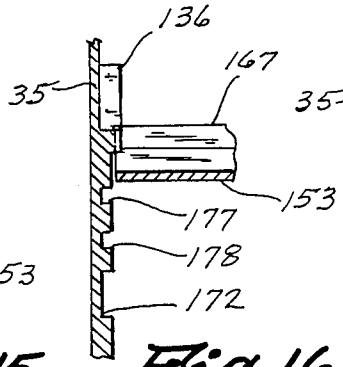
Figure 17:
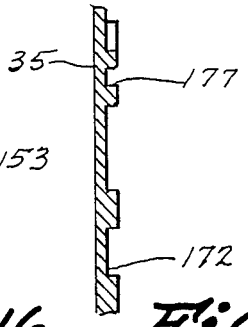

Referring to FIGS. 11, 18 and 19, a unique feature of the machine (20) is illustrated wherein the hood (23) is pivotally connected by an elongated rod (79), integral with the hood (23) by an elongated leg (81), to a cup-like socket (82) integral with the rear wall (36) of the base (32), which socket (82) is open at both ends. By this arrangement, the hood (23) can be pivotally movable vertically to a raised position as shown in solid lines in FIG. 11, thereby providing access to the interior of the machine (20) for the operator for loading, shelf removal and servicing purposes; and further, wherein the hood can be rotated upwardly additionally to clear the rear ends (83) of the side panels (37, 38) whereupon the hood (23) via the rod (79) can be moved laterally outwardly of the socket (82) to a position separated from the base (22). The hood (23) is automatically held in the raised position as shown in FIG. 11 by a bar (84) pivotally connected at one end to the hood (23) (see also FIG. 5), and with its lower end having a cut-out (85) formed therein for spring-biased engagement with a lug (80) formed on the inner wall (35) therefor upon raising the hood (23). To lower the hood (23), the operator moves the bar (84) out of engagement with the lug (80), with the spring (75) maintaining the bar (84) engaged in contact with the lug (80) as the hood is lowered for the next lifting operation.

As the upper and lower shelf units (24, 26) are substantially identical, the lower unit (26) (FIGS. 6–10) will be initially described, with differences as to the upper unit (24) described hereinafter. The unit (26) is of a molded, high-density plastic comprising generally a flat base (86), upstanding side walls (87), a rear panel (88), at least an inner pair of fixed dividers (89) for dividing the shelf unit (26) into at least three product feed channels (91) of equal width, and including a product vending coil unit (92) removably mounted in each feed channel (91). As illustrated, the base (86), side walls (87), rear panel (88) and dividers (89) are of one integral part, although the rear panel (88) and dividers (89) may be provided to be removably fitted to the remainder of the unit (26). As is well known in this art, a product (90) (FIG. 11) may be placed between convolutions of the coil (93) of one of the units (92), whereby upon customer selection of the unit (92) operably connected to that coil (93), by use of the coin selection mechanism described hereinbefore, upon rotation of that particular coil (93) the product (90) is moved forwardly of the coil (93) until it is moved past the front edge (95) (FIG. 11) of the base (86).

The shelf base (86) may have longitudinally and laterally spaced openings (96) (FIG. 9) formed therein for receiving lugs (97, 98) formed on the bottom edge of one or more dividers (89′) which are removably inserted into the openings (96) and intermediate a pair of fixed dividers (89) or a sidewall (87) and a divider (89) to form a pair of product feed channels (91′) (FIGS. 9 and 10), half the width of the larger channel (91). The rear panel (88) has a plurality of vertically disposed, laterally equidistantly spaced slots (99, 101) formed therein, each slot (99, 101) adapted to slidably receive and hold a drive motor unit (78) (FIG. 8) therein, with the unit (78), adapted to be conventionally connected as by a cotter pin (102) (FIG. 10) to the rear end of one of the coils (93), or to the rear end of a coil (93') of a smaller vending coil unit (92'). It will be noted that each of the three channels (91) of FIG. 9 show a trio of slots (99, 101) formed at the rear end thereof, with the longer slot (101) intermediate the outer two slots (99).

Figure 6:
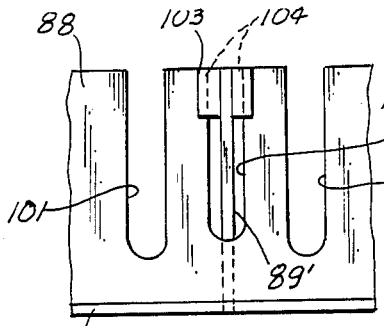
FIG. 6 is an enlarged elevational view of a detail of a shelf unit of this invention.
Figure 7:
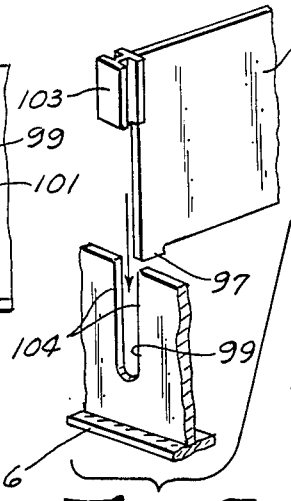
FIG. 7 is a perspective exploded view of elements of FIG. 6.
Figure 8:
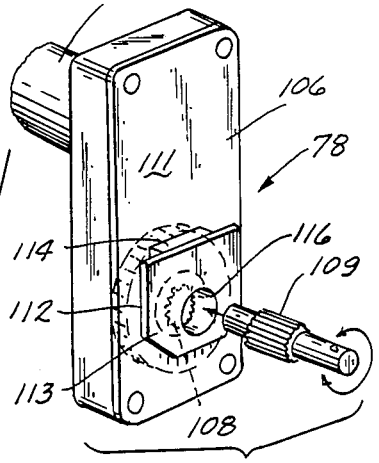
FIG. 8 is a perspective view of a drive motor unit of the invention.

The fixed dividers (89) and movable dividers (89') have a height and length substantially that of the sidewalls (87) and with the length longer than the depth of the base (86) to ensure proper vending of a product from a respective channel (91 or 91'). At the rear end of each movable divider (89') (FIGS. 6 and 7), an H-shaped element (103) is formed so as to embrace the edges (104) of a slot (99 or 101) whereby the divider (89') is slidably removably mounted within a slot (99 or 101) (FIG. 6).

Each unit (78) for driving or rotating a coil (93) otherwise known as an auger or helix is conventional in that it includes a housing (106) for a set of gears (not shown), a DC motor (107) with a snap action microswitch (not shown) mounted on the rear thereof for controlling the rotation of the drive gear (108) to which the drive shaft (109) is insertably connected. The unit (78) is improved, however, by having the housing face plate (111) (FIG. 8) integral with a T-shaped structure (112) having a face (113) and a stem element (114) adjacent one end of the face plate (111), and with a passage (116) formed therein to receive the shaft (109). The height of a unit (78) is less than the height of the rear panel (88), and the width of the T stem (114) is equal the width of a slot (99, 101) such that a unit (78) is slidably, frictionally and removably mounted in any one of the slots (99, 101).

Figure 9:
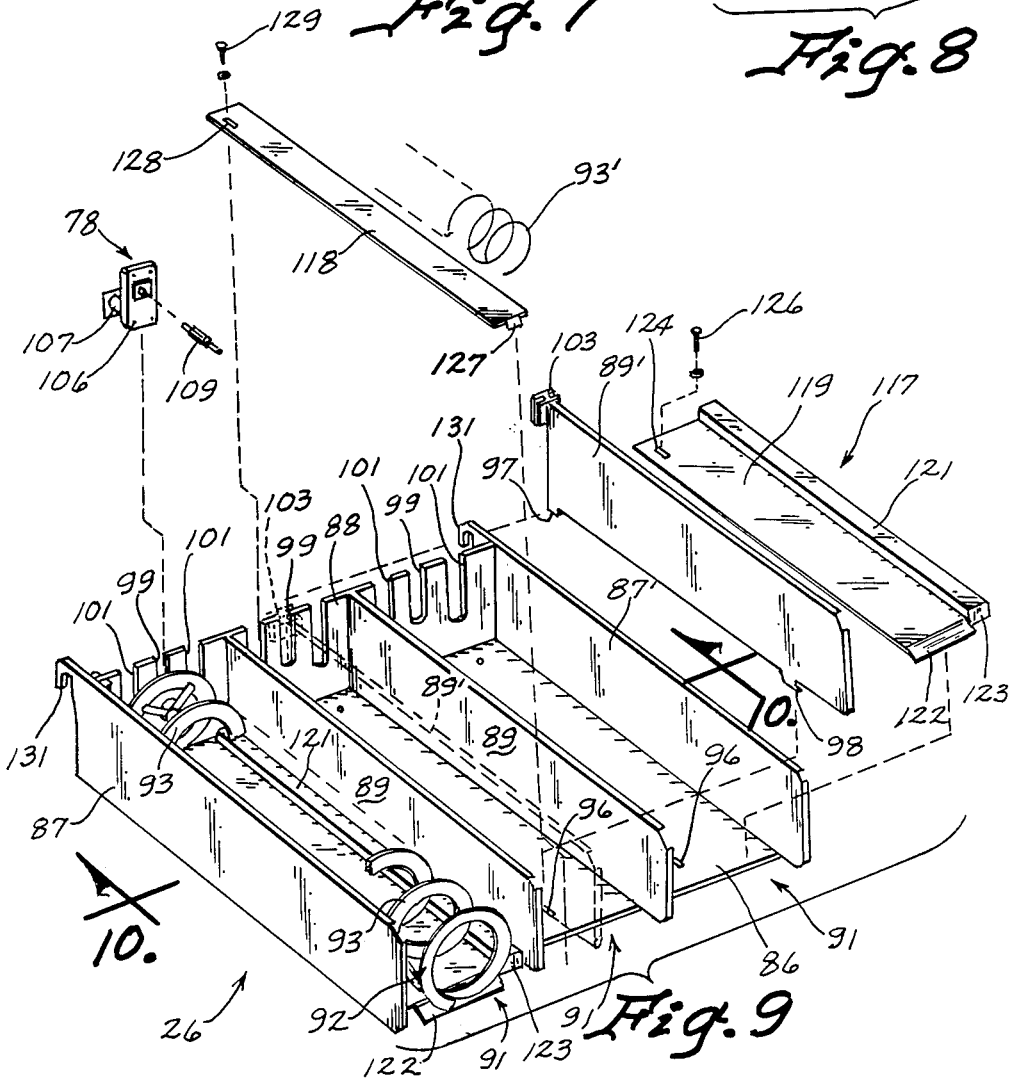
FIG. 9 is a perspective view of a shelf unit of this invention, with certain parts exploded therefrom.
Figure 10:
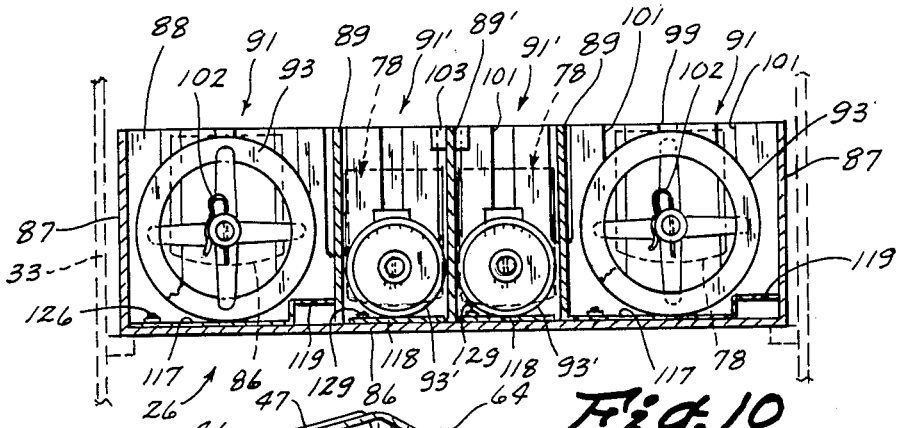
FIG. 10 is a vertical sectional view taken along the line 10—10 in FIG. 9, with all elements of the shelf unit in place.

By this arrangement, should a large helical coil (93) be placed within a channel (91) (FIG. 9), its drive unit (78) with the T-structure (112) up (FIG. 9), a position reversed from (FIG. 8), is mounted in the middle short slot (99) of the leftmost channel (91) as viewed in FIG. 9 for proper connection, as by a cotter pin (102) or other means to the rear end of the coil (93). As the coil (93) rests upon the base (86) of the shelf unit (26), or upon a subfloor (117) (FIG. 9), its position determines the actual location of the drive unit (78) within the slot (99), the slot (99) enabling the unit (78) to "float" therein to accommodate the diameter size of the large coil (93).

If a smaller channel (91') is formed, as by the insertion of a removably divider (89'), (shown in place in FIG. 9 by dotted lines), to accommodate the smaller coil (93') which is also placed either on the floor of the base (86) or upon another subfloor (118), the drive unit (78) is inserted downwardly in a slot (101) which is the leftmost slot (101) of the trio thereof in the next larger channel (91) formed by the fixed dividers (89), and connected to the smaller coil (93'). Another such arrangement is formed in the next adjacent small channel (91'), with that drive unit (78) inserted downwardly in the rightmost slot (101) of that trio of slots, the center shorter slot (99) thereof covered by the placement of the divider (89') therein, as shown in FIG. 6. Thus, the reversibility of the drive units (78) and the provision of the slots (99, 101) enables the same drive unit (78) to be mounted in any one of the three slots (99, 101) located in laterally spaced equidistant relation in the rear panel (88), and with connection to either a large coil (93) as determined by the proximity of a sidewall (87) or a divider (89, 89'), or a small coil (93'). Further, a respective drive unit (78) and coil (93), or unit (78) and coil (93') may be mounted on the shelf (26) as a preconnected unit, and removed as a connected unit without the use of any fastening devices at any time prior to or during placement of the machine (20) in location for operation. In one arrangement, the lower shelf unit (26) has three large coils (93) mounted therein, each connected to a drive unit (78) each of the latter being mounted in a respective one of the three short slots (99). It should be noted that the lengths of the slots (99, 101) need be only enough to accommodate the depth of a drive shaft (109) as determined by the diameter of the respective coil (93, 93') to which it is to be drivingly connected.

The subfloor element (117) for the larger coil (93) (FIGS. 9 and 10) has a flat section (119) for receiving the coil (93), a raised right angular section (121) for maintaining the coil (93) centered on its channel (91), a front depressed lip element (122) for aid in vending a product, and with a front face (123) of the section (121) for receiving product and price identifying indicia. A slot (124) is formed near the rear end of the section (119) for longitudinally adjustable mounting, as by a fastening device (126) to the base floor (86), the adjustable mounting aiding versatility of the coil (93) accommodating different types, sizes and wrappings of product to be vended. The subfloor element (118) (FIGS. 9, 10), like the element (117) has a length and width to substantially cover the base floor (86) within its channel (93'), and further is provided with a front lip (127), rear slot (128) and fastening device (129) again for longitudinally adjustable mounting on the base floor (86) and to enable the smaller coil (93') to accommodate different types, sizes and wrappings of product to be vended by the coil (93').

Each sidewall (87) (FIGS. 9, 10) is provided with a hook projection (131) at the rear for free pivotal engagement, the upper lug end (132) of a pivot arm (133) pivotally mounted at its lower end to a rod (134) extended transversely across the floor of the base bottom (32). This arrangement supports the lower shelf unit (26) at the rear end thereof, the front end supported on each side by an elongated member (136) (FIGS. 11, 12, 14) formed on the adjacent inner side of the inner wall (35) and on the opposite sidewall (33). As indicated by full and dotted lines in FIG. 11, the lower shelf (26) is rockably movable forwardly from an inner product vending position to an outer product loading position. This movement occurs by an operator grasping the shelf unit (26) and pulling it forwardly whereby it rocks about the rod (134) due to the pivot arm (133) and slides forwardly along the pair of support members (136). Return movement is effected in the same manner. With the upper shelf (24) in place, movement of the lower shelf (26) to its forwardly extended position increases the access area to it for the operator.

The upper shelf unit (24), as mentioned hereinbefore is substantially identical to the lower shelf unit (26). In one arrangement, with a trio of movable dividers (89') inserted each intermediate either a sidewall (87) and a fixed divider (89) or a pair of fixed dividers (89), six smaller product feed channels (91') are formed. The rear hook projections (131) engage opposed lugs (137) (FIG. 11) formed on the inside surfaces of the inner wall (35) and the opposite base sidewall (33). The front end of the upper shelf unit (24) rests upon a lug (138) formed on the adjacent inner wall (35) surface. With the hood (23) raised (FIG. 11), easy access by the operator to load and otherwise service the upper shelf unit (24) is provided. To increase access to the lower shelf unit (26) however, the upper shelf (24) may be lifted upwardly about its rear supports (137) to a raised position as illustrated by dotted lines in FIG. 11, and temporarily held there by a latch (139) movable through a slot (141) formed in the inner wall (35) and pivotal on a bracket (142) affixed thereto. Upon withdrawal of the latch (139), the upper shelf (24) may be lowered to its vending position, supported by the lugs (137, 138).

The coin collection box (53) has been described hereinbefore. A cover (143) for the rear area (52) may be provided to prevent accidental dislodgement of coins from the area (52); a slot (144) formed therein through which the coins fall and a pair of finger holes (146) for manipulating the cover (143). The cover (143) has a friction fit in the area (52) of the box (53).

Referring to FIGS. 11–17, the anti-theft product delivery drawer assembly (31) is best illustrated. In general, the drawer assembly comprises: a rectangular drawer (151) open at the top to receive product (90) therein from one of the shelf units (24 or 26) when it is biased in its its inner position by a biasing unit (152), the drawer movably outwardly of the machine (20) to an outer position shown in dotted lines in FIG. 13 whereby product (90) therein, if any, is exposed to the customer for retrieval; a cover plate (153) mounted directly below and generally parallel to lower shelf unit (26) and movable between an inner stored position (FIG. 13. full lines) wherein the drawer (151) is at least partially uncovered for receiving product (90) vended from one of the shelf units (24, 26), to an outer position (FIG. 13, dotted lines) wherein access to the interior of the machine (20) is blocked as by a customer's hand or fingers and further wherein should a product (90) be inadvertently vended, it is prevented from falling into the drawer (151): and a linkage unit (154) interconnected between the drawer (151) and the cover plate (153) for moving the cover plate (153) between inner and outer positions in concert with the drawer (151) moving between its inner and outer positions.

More particularly, the drawer (151) comprises a face panel (156) with a finger latch (157) secured thereto, a bottom (158), a rear panel (159), a shortened top panel (161) at the rear of the open portion of the drawer, and a pair of side panels (162) each having a triangular portion (163) at the rear thereof, an elongated guide (164) formed on the outer surface of each side panel (162), the guides (164) extended parallel the bottom (32) of the base (22) and the bottom (158) of the drawer (151) (FIG. 13), the guides (164) shown in dotted lines only.

The drawer (151) has a width such that it extends substantially the entire spacing between an adjacent base sidewall (33) and the inner wall (35), a depth whereby its rear panel (159) is disposed rearwardly of the front edge (95) of the lower shelf unit base (86), and a height that places its top panel leading edge (166) substantially vertically aligned with the leading edge (167) of the cover plate (153) and the front edge (95) of the lower shelf unit base (86). This arrangement leaves sufficient open space at the top of the drawer (151) for the product (90) to drop into the drawer (151) when the drawer (151) is in its inner position and the product (90) is vended from shelf unit (24 or 26).

The biasing unit (152) comprises a spring (168) secured between a block (169) mounted at the center rear of the drawer rear panel (159) and a rod (171), the free end of the rod (171) hooked to the rod (134) (FIG. 12) midpoint thereof. The spring (168) tends to maintain the drawer (151) in its inner position at all times and upon a customer pulling the drawer (151) outwardly, will automatically return the drawer (151) to its inner position upon release thereof by the customer. As best illustrated in FIG. 13, the drawer (151) moves parallel the bottom (32) of the base (22) due to the elongated guides (164) sliding parallel the bottom (32) within elongated grooves (172) (FIGS. 14 and 17) formed therefor in the inner opposed surfaces of the base sidewall (33) and the inner base wall (35), the grooves (172) disposed parallel the base bottom (32).

The cover plate (153) has a width substantially equal that of the drawer (151) and a depth that enables it to move from its inner position (FIG. 13) to its outer position wherein its leading edge (167) is proximate the vertical front portion (173) (FIG. 14) of the hood (23), thereby preventing inadvertently vended product (90) from falling into the drawer (151) while preventing unauthorized access through the drawer opening into the interior of the machine (20). To guide the movement of the cover plate (153), it is provided with a pair of longitudinally spaced protruding pins (174, 176) (FIGS. 12, 14) formed on each lateral edge, which pins (174, 176) extend into and are guided respectively by a pair of longitudinally smoothly curved vertically spaced grooves (177, 178) (FIGS. 14, 15) each pair of which is formed in the inner shelf surface of wall (35) and the inner surface of sidewall (33).

Figure 13:
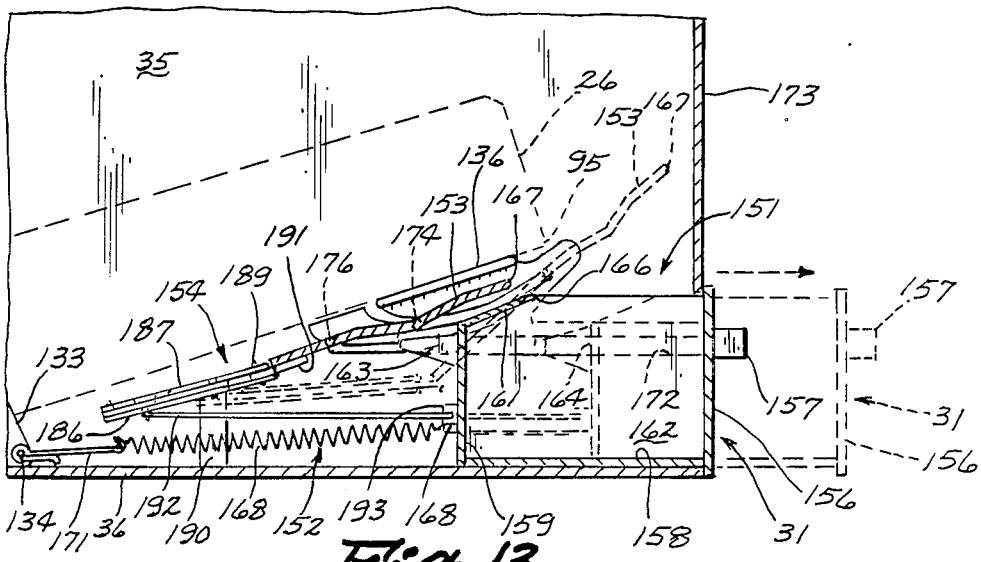
FIG. 13 is a vertical sectional view taken along the line 13—13 in FIG. 12, and showing the anit-theft drawer and associated parts in inner and outer positions by the use of dotted lines.
Figure 14:
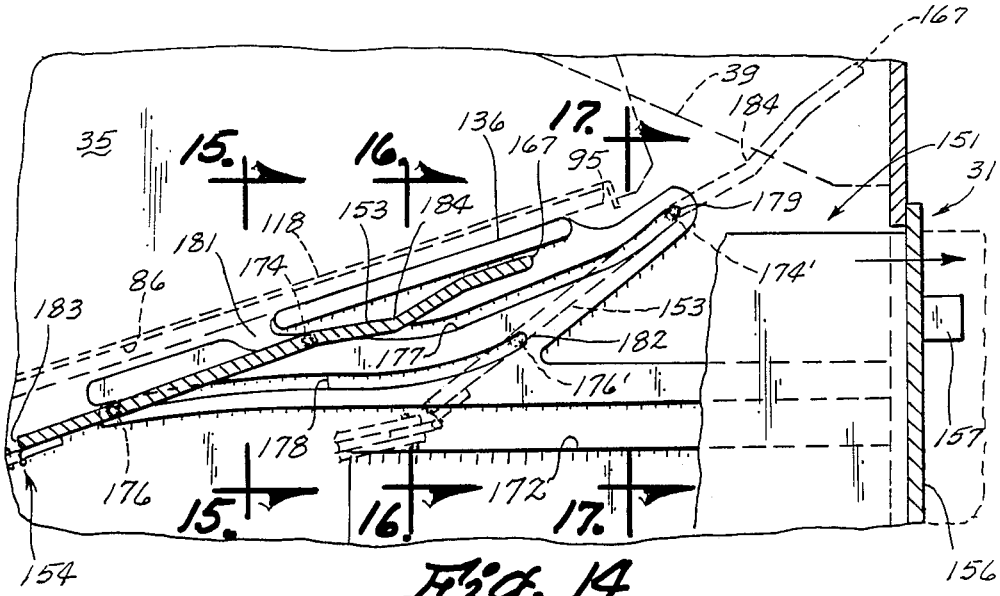
FIG. 14 is an enlarged detailed view taken along the line 14—14 in FIG. 12, and showing the molded grooves formed for guiding movement of the anti-theft drawer and cover therefor.

Referring to FIG. 14, it is seen that the front end (179) of each upper groove (177) begins slightly forwardly of the shelf front end (95) inner position, and curves slightly downwardly and rearwardly to the rear end (181) of the lower shelf support (136). The front (182) of the lower groove (178) begins directly below the cover plate front edge (167) and also curves slightly downwardly and rearwardly to a placement (183) rearwardly of the end (181), it being noted that the grooves (177, 178) are generally parallel each other, although longitudinally offset. The cover plate (153) is generally flat and straight in cross section (FIG. 14), having a slight depressed portion (184) intermediate its depth; such that as it is moved from its inner stored position wherein the drawer (151) is at least partially uncovered (FIG. 12) to receive product (90), to its outer position (FIGS. 13, 14) wherein the cover plates' leading edge (167) is closely adjacent the front (173) of the hood (23), the depressed portion (184) clears the front (95) of the lower shelf unit (26). Note that the cover plate pins (174, 176) ride forwardly and slightly upwardly within their respective guide grooves (177, 178) and to the forward ends (179, 182) of each groove (177, 178), respectively.

By this movement of the cover plate (153), at its outer position it prevents unauthorized access as by hand, fingers or other objects, to the interior of the vending machine (20) through the interior of the drawer (151), and further its leading edge (167) is sufficiently high above the drawer (151) to obviate pinching a product (90) within the drawer (151) between the edge (167) and the hood front (173).

Figure 12:
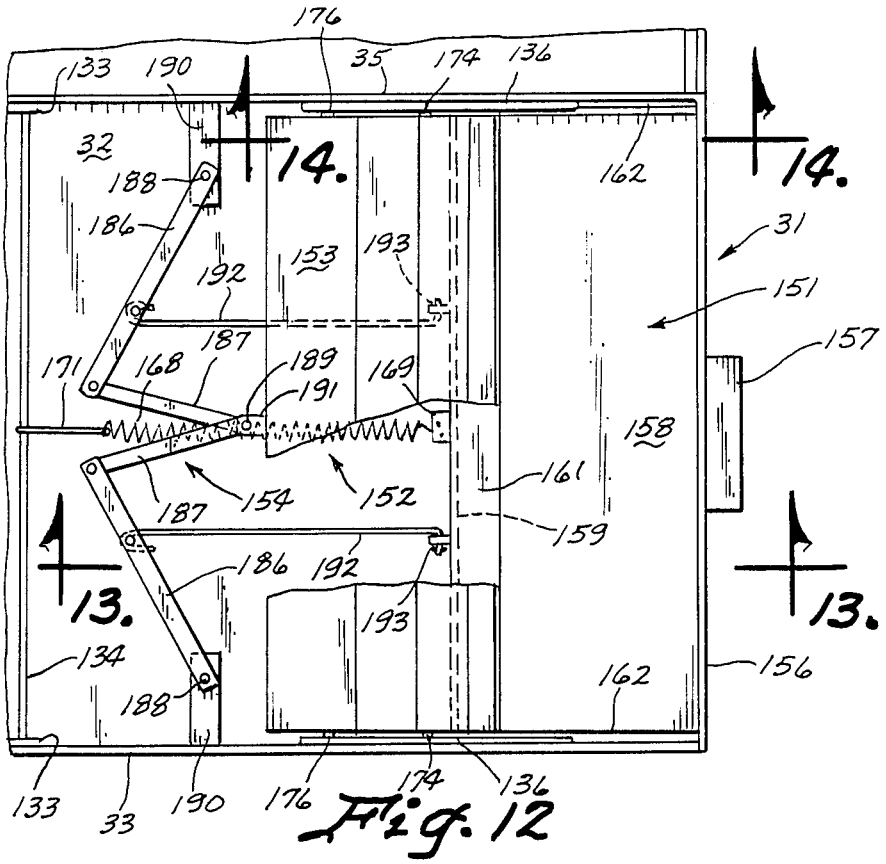
FIG. 12 is a horizontal sectional view taken along the line 12—12 in FIG. 11, with certain lines broken away for clarity.

Movement of the cover plate (153) is effected in concert with movement of the drawer (151) by operation of an articulated linkage assembly indicated generally at (154) in FIGS. 12, 13, which assembly (186) interconnects the drawer (151) with the cover plate (153), and further causes the cover plate (153) not only to move simultaneously fore and aft with like movement of the drawer (151), but it will be noted the movement of the cover plate (153) is greater than the drawer (151) movement. The linkage unit (154) includes two pairs of pivotally connected links (186, 187), each pair connected to an outer end (188) to base pedestals (190) (FIG. 12) and pivotally connected together at (189) to a projection (191) formed at the rear center of the cover plate (153). A pair of wire rods (192) is connected between the links (186) and laterally spaced apertured projections (193) formed on the rear panel (159) of the drawer (151) to effect the plate (153) drawer (151) connections.

It should be noted that as the drawer (151) (FIG. 13) may be withdrawn to its outermost position by the customer without the vending of a product, with the drawer (151) pulled out, product may then be vended. The product will then fall onto the extended cover plate (153) now disposed over the drawer (151). Due to the aforementioned contiguous nature of the cover plate (153) with the front edge (95) of the lower shelf base (86), the cover plate (153) is operable to temporarily hold the product thereon until the drawer (151), and thus the cover plate (153) are returned to their inner stored positions, whereupon the vended product drops into the drawer (151) for retrieval by the customer upon subsequent movement of the drawer (151) to its outer position.

While the invention has been described with reference to a particular embodiment, other changes or modifications may be suggested to those skilled in the art without departing from the inventive concept or scope of the appended claims.

We claim:

1. A vending machine for a table top or like comprising:

housing means including a hood element hingedly connected for arcuate movement between a closed position denying access to the interior of the machine and a raised position enabling access thereto, said hood element having a transparent portion;

shelf means mounted within said housing means and carrying a plurality of driven helical feeder coils thereon, each coil adapted to receive items of merchandise between the convolutions thereof for axial advance responsive to rotation of said coil for dispensing said items one-by-one at one end of said coil forwardly of said shelf means, said items being dispensed viewable through said hood portion by the customer;

product selection means mounted within said housing means on one side of said shelf means for selected actuation of one of said feeder coils; and anti-theft drawer means mounted within said housing means below said shelf means for receiving a dispensed item of merchandise advanced off said shelf means, said drawer means customer operated to deliver said dispensed item for retrieval by said customer;

and further wherein said drawer means comprises a drawer open at the top and biased inwardly of the machine to a position below said shelf means to receive product therefrom, said drawer movable outwardly of said machine to a position exposing the product therein;

a cover plate slidably mounted on said housing and movable between an inner stored position wherein said drawer is adapted to receive product to an outer position preventing product vended off said shelf means from falling into said drawer; and means connected between the drawer and said cover plate for moving said cover plate in concert with said drawer.

2. The invention of claim 1 and further wherein said cover plate extends below and in contiguous relation with the front of said shelf means, whereby product inadvertently vended off said shelf means when said drawer is in its outer position falls upon said cover plate and remains on same until said drawer and said cover plate are returned to their inner positions, whereupon the product drops from said cover plate into said drawer.

* * * * *